United States Patent [19]

Maruyama

[11] 4,096,851

[45] Jun. 27, 1978

[54] LIQUID HEATING APPARATUS

[76] Inventor: Noboru Maruyama, No. 26-14, Shirasagi 2-chome, Nakano-ku, Tokyo, Japan

[21] Appl. No.: 708,189

[22] Filed: Jul. 23, 1976

[30] Foreign Application Priority Data

Aug. 11, 1975 Japan ..... 50-96682

[51] Int. Cl.[2] ..... F22B 7/10

[52] U.S. Cl. ..... 126/350 R; 122/160

[58] Field of Search ..... 122/182 R, 165, 160, 122/161; 126/350

[56] References Cited

U.S. PATENT DOCUMENTS

| | | | |
|---|---|---|---|
| 1,837,597 | 12/1931 | Thomas | 122/165 |
| 1,865,939 | 7/1932 | McPhee | 122/182 R |
| 2,173,115 | 9/1939 | Hutto | 122/182 R |
| 2,189,365 | 2/1940 | Kucher | 122/182 R |
| 3,358,651 | 12/1967 | Maruyama | 122/160 |

*Primary Examiner*—John J. Camby
*Assistant Examiner*—Larry I. Schwartz
*Attorney, Agent, or Firm*—Blanchard, Flynn, Thiel, Boutell & Tanis

[57] ABSTRACT

A liquid heating apparatus according to the present invention comprises an outer body portion, an inner body portion which is disposed within said outer body portion so as to provide space forming an outside water jacket, an inside water jacket which is provided within said inner body portion and communicates with said outside water jacket by way of its upper and lower parts, a rising heated gas chamber disposed along one side of said inside water jacket and a falling heated gas space disposed along the other side of the same, said rising heated gas chamber and falling heated gas space being so devised that the ratio $\xi f$ of the width $Wd$ of the gas passage of the falling heated gas space to the width $Wu$ of the gas passage of the rising heated gas chamber satisfies the inequality $0<\xi f\leqq 0.8$, a flue which is provided at the upper part of the rising heated gas chamber and communicates with the upper part of the falling heated gas space, and a flue gas exit which is provided at the lower part of the falling heated gas space.

4 Claims, 16 Drawing Figures

LIQUID HEATING APPARATUS

BACKGROUND OF THE INVENTION

The present invention relates to a liquid heating apparatus for use in a boiler and the like utilizing an up/-down flow process with respect to the heated gas.

The so-called 'up/down flow process' herein means a method wherein a heated gas is made to flow in an inverted U-shaped gas passage so as to effect heat exchange between the flowing heated gas and a liquid surrounding said gas passage, whereby the temperature of the heated gas is gradually lowered with its progress and the downward movement of the gas in the falling portion of the gas passage is facilitated to enhance the draft power of the passage, smooth the discharge of carbon dioxide as well as the supply of air and raise the combustion efficiency. This process will first be explained.

Referring to FIG. 1 in the appended drawings, when the pressure acting upon the point A (the heat source) and the point B (the flue gas exit) on the datum level L and the point C of the height H of an inverted U-shaped gas passage X is expressed by $P_A$, $P_B$ and $P_C$, respectively, the relations of these points are expressed by the following equations.

$$P_A = P_C + \int_O^H \gamma_a dh \quad (1)$$

$$P_B = P_C + \int_O^H \gamma_b dh \quad (2)$$

$\gamma_a$ and $\gamma_b$ herein represent the specific weight of the liquid within the gas passage X at an optional height ($0<H$) above A and B, respectively. When the pressure $P_B$ acting upon the point B is equivalent to atmospheric pressure $P_O$, since $P_{B=PO}$, from the equation (2), $$P_B = P_O P_C + \int_O^H \gamma_b dh \quad (3).$$

When the equation (1) is substituted by the equation (3), $$P_A = P_O - \left( \int_O^H \gamma_b dh - \int_O^H \gamma_a dh \right) \quad (4),$$

and the pressure acting upon the point A is lower than the atmospheric pressure by an equivalent of $$\int_O^H \gamma_b dh - \int_O^H \gamma_a dh.$$

When the draft power P*ch* on this occasion is expressed by the following equation $$Pch = \int_O^H \gamma_b dh - \int_O^H \gamma_a dh \quad (5),$$

in the case of $Pch>0$, the pressure acting upon the point A can be expressed by $P_A<P_C$ (negative pressure), and a flow in the direction of $A \rightarrow C \rightarrow B$ takes place. In the case where radiation occurs in the portion ACB of the gas passage X to give rise to a thermal gradient along the direction of the gas passage, $\gamma_a$ and $\gamma_b$ take the value that $$\gamma_a = f(h)\ \gamma_b = f(h) \ldots (6),$$

and the equation (5) can be expressed as follows.

$$Pch = \int_O^H (\gamma_b - \gamma_a) dh \quad (7)$$

Accordingly, in order to realize the state of $Pch>0$, the relation between $\gamma_a$ and $\gamma_b$ in the equation (7) should be as follows.

$$\gamma_{b-\gamma a} > 0\ \gamma_{b>\gamma a} \ldots (8)$$

Consequently, the greater is the value of $(\gamma_b - \gamma_a)$ as well as the value of H, the greater becomes the flow.

Next, from the following equations expressing the state of a perfect gas $$PV = RT,\ V = (1/\gamma),$$

$$(P/\gamma) = RT,\ \gamma = (P/RT) \ldots (9)$$

wherein,

*P*: gas pressure, $kg/m^2$;
*V*: volume of gas, $m^3$;
*R*: constant for fluid gas, kgm/kg°K ;
*T*: absolute temperature, °K :
$\gamma$: specific weight of gas, $kg/m^3$.

Accordingly, $$\gamma_b - \gamma_a = \frac{P}{R}\left(\frac{1}{Tb} - \frac{1}{Ta}\right) \quad (10)$$

From this equation, it is clear that the smaller is the ratio of T*b* to T*a*, the greater becomes the value of $\gamma_b - \gamma_a$ and consequently the value of P*ch* becomes greater (T*a* and T*b* herein represent the absolute temperature of the gas within the supply pipe at an optional height above the point A and point B).

It will be understood from the above description that the draft power is closely related to the difference of density between the rising gas passage and the falling gas passage, and the greater is the difference of density between the two passages, to wit, the greater is the difference of temperature between the rising heated gas chamber and the falling heated gas space, the greater is the draft power that is generated.

To cite an instance of the liquid heating apparatus utilizing the above described up/down flow process developed hitherto, there has been proposed an apparatus such as shown in FIG. 2 by the present inventor. This previously proposed apparatus is of a structure such that an inner body portion 41 is installed within an outer body portion 40 by leaving a required space between the two so as to form an outside water jacket 45, an inside water jacket 46 defined by a double wall consisting of flat plate-shaped members, said inside water jacket communicating with said outside water jacket at the upper and lower parts thereof, is installed within said inner body portion 41, a rising heated gas chamber 42 is formed along one side of said inside water jacket 46 while a falling heated gas space 43 is formed along the other side of the same, a flue communicating with said falling heated gas space 43 is provided at the upper part of said rising heated gas chamber 42, and a flue gas exit 44 is provided at the lower part of said falling heated gas space 43.

However, a liquid heating apparatus of such a structure is defective in that, inasmuch as the heated gas heats the upper part *c* of the inner body portion 41 intensely, the temperature of the upper part *a* of the outside water jacket 45 rises rapidly compared with the lower part *b* thereof, while the heating of the liquid within the lower part *b* of said water jacket 45 is insufficient and, therefore, the thus insufficiently heated liquid stagnates in the upper part a of the outside water jacket 45, natural convection of the liquid is hampered thereby making it difficult to raise the combustion efficiency as well as the thermal efficiency, to wit, as for the thermal efficiency in particular, achievement of more than 70% is infeasible, and moreover NO*x* which is very harmful to the environmental sanitation as well as the durability of the apparatus is generated.

However, development of a liquid heating apparatus capable of achieving thermal efficiency of more than 70% has recently been hoped for. Accordingly, the present inventor has examined the foregoing drawbacks of the existing apparatuses in every way and has come to the finding that those drawbacks are related to the ratio of the width Wd of gas passage of the falling heated gas space 43 to the width Wu of the gas passage of the rising heated gas chamber 42 as well as the ratio of the width B*i* of the passage of the inside water jacket to the width B*o* of the passage of the outside water jacket, to wit, in the case where W*d*/W*u* and B*i*/B*o* are respectively about 0.8 or more, there occurs such a phenomenon as seen in conventional apparatuses, while in the case where said ratios are respectively 0.8 or less than 0.8, said phenomenon disappears and a thermal efficiency of more than 70% can be achieved.

And, this effect is considered attributable to the fact that, by virtue of setting the value of said Wd/Wu at 0.8 or less than 0.8, heat exchange between the heated gas and the liquid surrounding the gas passage is performed efficiently, and as a result, the temperature of the heated gas is lowered remarkably and the downward movement of the gas in the falling portion of the gas passage is facilitated thereby to enhance the draft power, smooth the discharge of carbon dioxide as well as the supply of air and raise the combustion efficiency, and also by virtue of the value of said B*i*/B*o* being 0.8 or less than 0.8, the heat capacity of the liquid within the inside water jacket 46 is less than that of the outside water jacket 45 and the inside water jacket 46 is heated with the heated gas by way of both sides thereof, and as a result, the temperature of the liquid within the inside water jacket 46 is raised rapidly while the temperature of the liquid within the outside water jacket 45 is not so rapidly raised compared with the liquid within the inside water jacket 46; consequently, there occurs rising current of liquid within the outside water jacket 45 due to the sudden rising flow as in boiling, and by virtue of this rising current, these occurs an increase of pressure in the upper part of both the outside and the inside water jacket 45, 46, and this increase of pressure, coupled with the difference of the temperature of liquid within the foregoing water jackets 45, 46, gives rise to a downward movement of the liquid within the outside water jacket 45, whereby there is generated a remarkable convective movement of the liquid within a closed passage including the both water jackets 45, 46.

SUMMARY OF THE INVENTION

The present invention has been achieved on the basis of the foregoing finding, and it is intended for providing a liquid heating apparatus which not only eliminates the drawbacks of the conventional liquid heating apparatuses and achieves a thermal efficiency of more than 70% but also is free from generating NO*x* which is very harmful to the environmental sanitation as well as the durability of apparatus per se.

The object of the present invention is to provide a liquid heating apparatus which comprises an inner body portion disposed within a vertical hexahedral outer body portion and spaced therefrom so as to form an outside water jacket, two vertically oriented plate members disposed within said inner body portion with there being a space between the two plate members forming on inside water jacket and spaces between the plate members and the walls of inner body portion forming a rising heated gas chamber along one side and a falling heated gas space along the other side of the latter space, said rising heated gas chamber communicating with said falling heated gas space at their upper ends and the ratio $\xi f$ of the width W*d* of said falling heated gas space to the width W*u* of said rising heated gas chamber being set at 0.8 or less than 0.8, whereby the drop of the gas temperature while it flows can be accelerated to enhance the draft power, the discharge of carbon dioxide as well as the supply of air can be smoothed, the combustion efficiency can be improved and the generation of harmful NO*x* can be controlled.

Another object of the present invention is to provide a liquid heating apparatus comprising a vertical cylinder-shaped first outer body portion, a first inner body portion which has a shape practically the same as that of said first outer body portion and is disposed within the latter so as to leave a first space defining an outside water jacket, a second outer body portion which has a shape practically the same as that of the first inner body portion and is disposed within the latter and is spaced therefrom to define a second space for falling heated gas, and a second inner body portion which has a shape practically the same as that of said second outer body portion and is disposed within the latter and is spaced therefrom so as to form a third space which defines an inside water jacket and also forms a rising heated gas chamber within said second inner body portion, wherein said inside and outside water jackets intercommunicate at their upper and lower ends and said rising heated gas chamber and falling heated gas space intercommunicate at their upper ends, the ratio of the radius R of said falling heated gas space to the radius *r* of said rising heated gas chamber (in the case where the inside and outside water jackets are of truncated cone shape, R and *r* represent the mean radius respectively) is set at a value satisfying the inequality $0<(R/r) - 1 \leqq 0.8$, whereby the falling of the temperature of the heated gas while flowing can be accelerated to enhance the draft power, the discharge of carbon dioxide as well as the supply of air can be smoothed, the combustion efficiency can be improved and the generation of harmful NO*x* can be controlled.

A further object of the present invention is to provide a liquid heating apparatus which is so designed that the heated gas having its combustion efficiency improved as stated above heats the inside water jacket on both sides thereof within the rising heated gas chamber and the falling heated gas space and, as a result, the temperature of the liquid within the inside water jacket rises rapidly while the temperature of the liquid within the outside water jacket rises relatively slowly, thereby giving rise to a rising current of the liquid within the inside water jacket, and by virtue of this rising current, there occurs an increase of pressure in the upper part of both water jackets which causes a falling current of the liquid within the outside water jacket in concert with the difference of temperature of the liquid within both water jackets, whereby a smooth convective movement of the liquid can be achieved within the closed passage including both water jackets, a rapid rise of the temperature of the upper part of the outside water jacket corresponding to the top of the gas passage relative to the lower part of said water jacket such as seen in conventional apparatuses can be prevented and the entire liquid can be heated uniformly and quickly, and accordingly, the apparatus minimizes combustion noise, and can be manufactured at moderate cost as the structure thereof is simple.

A still further object of the present invention is to provide a liquid heating apparatus which is so devised that by virtue of setting the ratio of the width of the passage of the inside water jacket to the width of passage of the outside water jacket at 0.8 or less than 0.8 thereby making the heat capacity of the liquid within the inside water jacket smaller than that within the outside water jacket, coupled with heating the inside water jacket by the heated gas on both sides thereof as stated above, the temperature of the liquid within the inside water jacket rises rapidly while the temperature of the liquid within the outside water jacket does not rise so rapidly compared with the temperature of the liquid within the inside water jacket, and consequently, there occurs a rising current of liquid within the inside water jacket due to the sudden rising flow as in boiling thereby causing an increase of the pressure in the upper part of both the outside and inside water jackets, and by the synergy of this increase of pressure and the difference of pressure within both water jackets, a falling current of liquid within the outside water jacket occurs, whereby a remarkable convective movement of the liquid can be brought about within the closed passage including both water jackets.

BRIEF DESCRIPTION OF THE DRAWING

In the appended drawings:

FIGS. 13 and 14 are respectively graphs illustrating the results of tests conducted by varying the width of the water passage in the first and second embodiments.

DETAILED DESCRIPTION OF THE INVENTION

Figure 1:
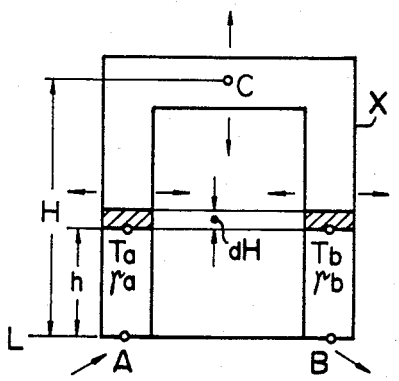
FIG. 1 is a diagram illustrative of the up/down flow process with respect to the heated gas.
Figure 2:
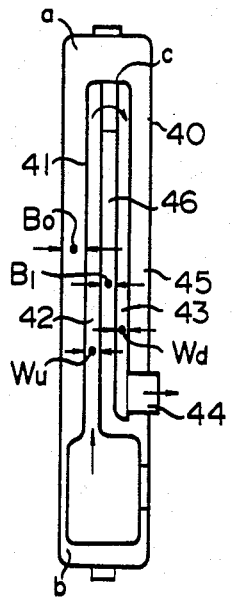
FIG. 2 is a schematic representation of a longitudinal sectional view of a conventional liquid heating apparatus.
Figure 3:
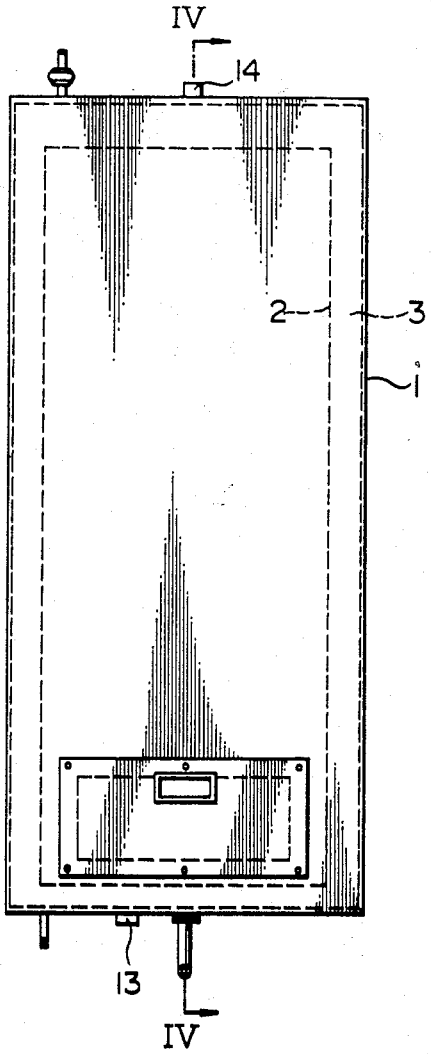
FIG. 3 is a front view of the first embodiment of the liquid heating apparatus according to the present invention.
Figure 4:
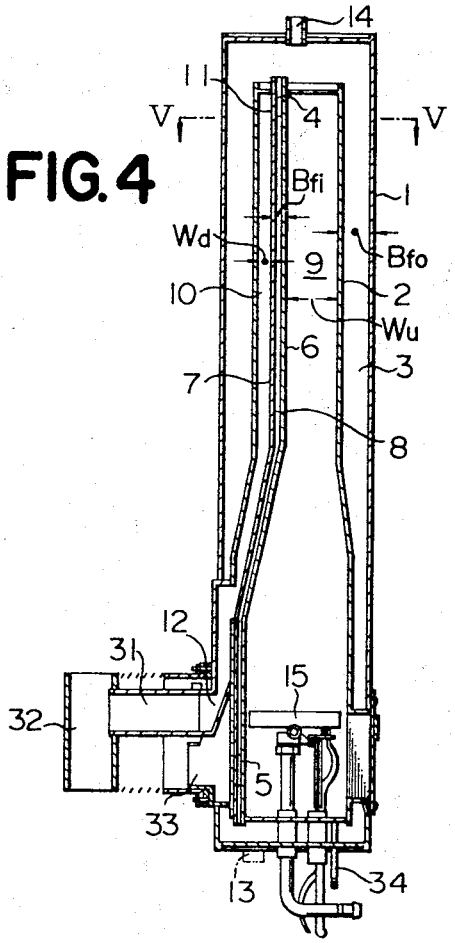
FIG. 4 is a cross-sectional view taken along the line IV—IV in FIG. 3.
Figure 5:
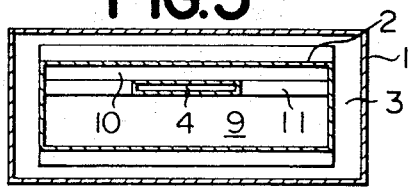
FIG. 5 is a cross-sectional view taken along the line V—V in FIG. 4.

In FIGS. 3 through 5 illustrating the first embodiment of the present invention, the reference numeral 1 denotes a vertical hexahedral outer body portion. Within this outer body portion is disposed a vertical hexahedral inner body portion 2 with there being a space therebetween so as to form an outside water jacket 3 between the outer and inner body portions. Within this inner body portion 2 is disposed a flat board-shaped inside water jacket 8 composed of two vertically oriented plate members, said inside water jacket 8 communicating with the foregoing outside water jacket 3 through an upper convection coupling member 4 and a lower convection coupling member 5. Along one side of the inside water jacket 8 is formed a rising heated gas chamber 9 while along the other side of the same is formed a falling heated gas space 10 so as to make the ratio Sf of the width Bfi of liquid passage of the inside water jacket 8 to the width Bfo of liquid passage of the outside water jacket 3 satisfy the inequality $0 \leqq Sf \leqq 0.8$ and also make the ratio $\xi f$ of the width Wd of gas passage of the falling heated gas space 10 to the width Wu of gas passage of the rising heated gas chamber 9 satisfy the inequality $0 < \xi f \leqq 0.8$. The upper part of the rising heated gas chamber 9 is provided with a flue 11 communicating with the falling heated gas space 10, while the lower part of the falling heated gas space 10 is provided with a flue gas exit 12 leading to the outside of the apparatus. 13 denotes a water entrance, 14 denotes a hot water faucet, and 15 denotes a combustor such as a gas burner and the like.

As for the operation of this apparatus, when combustion is effected by means of an appropriate combustor 15, e.g., a gas burner and the like disposed beneath the rising heated gas chamber 9 upon falling the liquid in the outside water jacket 3 defined by the outer body portion 1 and the inner body portion 2 as well as the flat board-shaped inside water jacket 8 through the water entrance 13, the heated gas rises within the rising heated gas chamber 9 defined by the inner wall of the inner body portion 2 and the inner wall of the inside water jacket 8, runs against the inner wall of the upper part of the rising heated gas chamber 9, has its direction of flow rectified thereat, passes the flue 11, falls within the falling heated gas space 10 defined by the inner wall of the inner body portion 2 and the outer wall of the inside water jacket 8 and is discharged to the outside of the apparatus through the flue gas exit 12 provided at the lower part of said falling heated gas space 10. The heated gas performs the heat exchange efficiently on the surface of the plate members 6, 7 of the inside water jacket 8 during its movement, heats the liquid within the inside water jacket 8 as well as the liquid within the outside water jacket 3 defined by the outer body portion 1 and the inner body portion 2, brings about a natural convection of the liquid within the inside water jacket 8 and the outside water jacket 3 by utilizing the inside water jacket 8 for convective rising of the liquid due to the sudden rising flow as in boiling and the outside water jacket 3 for convective falling of the liquid, respectively whereby the liquid within the apparatus is uniformly heated and hot water can be obtained quickly.

Moreover, the heated gas is supposed to pass the flue gas exit 12, enter the exhaust pipe 31, run against the inner wall of the funnel 32 attached to the fore end of said exhaust pipe 31, change its direction of flow and go outside through an opening of said funnel 32. The space between the fore end of the exhaust pipe 31 and the inner wall of the funnel 32 is designed to be narrower than the width of the opening of the funnel 32, and therefore, on the occasion of discharging the heated gas through the exhaust pipe 31, by virtue of a suction force working therein, the speed of current of the gas to be discharged is accelerated to improve the fluidity thereof and ensure the supply of air sufficient for combustion through the air supply tube 33, whereby a complete combustion is effected. 34 denotes a drain tube.

Figure 6:
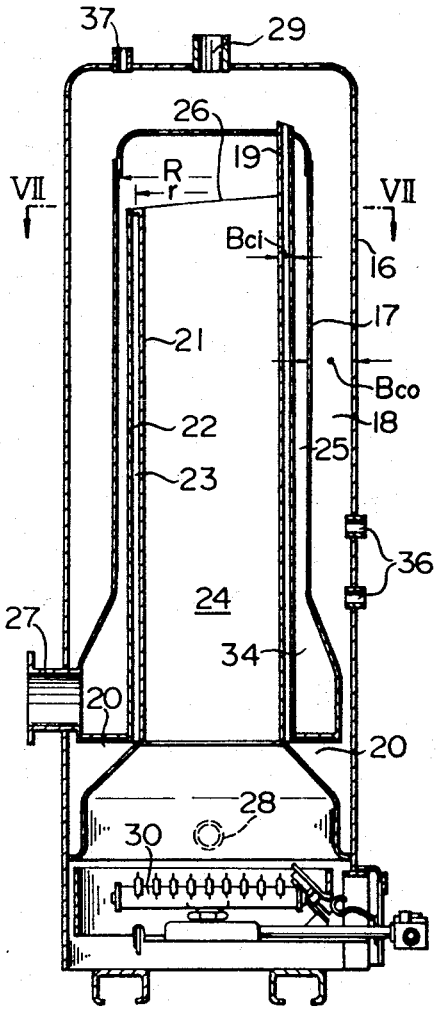
FIG. 6 is a longitudinal sectional view of the second embodiment of the liquid heating aparatus according to the present invention.
Figure 7:
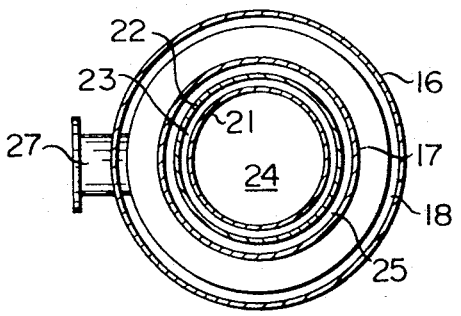
FIG. 7 is a cross-sectional view taken along the line VII—VII in FIG. 6.

In FIGS. 6 and 7 illustrating the second embodiment of the present invention, the reference numeral 16 denotes a first outer body portion of cylindrical shape. Within this outer body portion 16 is disposed a cylindrical first inner body portion 17 with there being a space therebetween forming an outside water jacket 18. Within this inner body portion 17 is vertically disposed a cylindrical inside water jacket 23 which is defined by a cylindrical second outer body portion 22 and a cylindrical second inner body portion 21 and communicates with said outside water jacket 18 by way of the upper and lower convection coupling members 19 and 20. Along the inside of said inside water jacket 23 is formed a rising heated gas chamber 24, while along the outside of the same water jacket is formed a falling heated gas space 25 so as to make the ratio $Sc$ of the width $Bci$ of liquid passage of the inside water jacket 23 to the width $Bco$ of liquid passage of the outside water jacket 18 satisfy the inequality $0<Sc\leqq 0.8$ and also make the ratio of a radius $r$ of said rising heated gas chamber 24 to a radius R of said falling heated gas space 25 satisfy the inequality $0<(R/r)-1\leqq 0.8$. The upper part of the rising heated gas chamber 24 is provided with a flue 26 communicating with the falling heated gas space 25, while the lower part of the falling heated gas space 25 is provided with a flue gas exit 27 leading to the outside of the apparatus. 28 denotes a water entrance, 29 denotes a hot water faucet, 30 denotes a combustor such as a gas burner and the like, and 34 denotes an enlarged portion of the falling heated gas space.

As for the operation of this apparatus, when combustion is effected by means of an appropriate combustor 30, e.g., a gas burner and the like disposed beneath the rising heated gas chamber 24 upon filling a liquid, to wit, water, in the outside water jacket 18 defined by the first outer body portion 16 and the first inner body portion 17 as well as the inside water jacket 23 defined by the second outer body portion 22 and the second inner body portion 21, the heated gas rises within the rising heated gas chamber 24 defined by the inner body portion of the inside water jacket 23, runs against the inner wall of the upper part of the rising heated gas chamber 24, changes its direction of flow thereat, passes the flue 26, falls within the falling heated gas space 25 defined by the inner wall of the inner body portion 17 and the outer wall of the outer body portion 22 and is discharged to the outside of the apparatus through the flue gas exit 27 provided at the lower part of said falling heated gas space 25. The heated gas performs the heat exchange efficiently on the surface of the inner wall of the inner boby portion 17 and the wall surfaces of the inner and outer body portions 21 and 22 during its circular movement, heats the water within the inside water jacket 23 as well as the water within the outside water jacket 18, brings about a natural convection of the water within the inside water jacket 23 and the outside water jacket 18 by effecting convective rising of water in the former jacket 23 while effecting convective falling of water in the latter jacket 18, whereby the water within the apparatus is uniformly heated.

Moreover, at the time when the heated gas fallen within the falling heated gas space 25 passes the enlarged falling heated gas space 34 below said space 25, which is wider than the width of the space 25, and is discharged to the outside from the flue gas exit 27, because the exit of the falling heated gas space 25 is narrower than the width of the enlarged falling heated gas space 34, by virtue of a suction force working therein, the speed of the current of the heated gas to be discharged is accelerated to improve the fluidity thereof and ensure a sufficient supply of air necessary for combustion from beneath.

Since an apparatus according to the present invention is of such construction as described above, it has a wide range of application such as a variety of water heaters as well as instantaneous water heaters for domestic use, boilers as well as waste heat recovering devices for industrial use, etc. and is very effective in economizing energies and resources. The liquid for use in the present invention can be water and other liquids.

In the following will be shown the results of tests conducted by the use of the respective liquid heating apparatuses illustrated by the foregoing embodiments of the invention.

Figure 8:
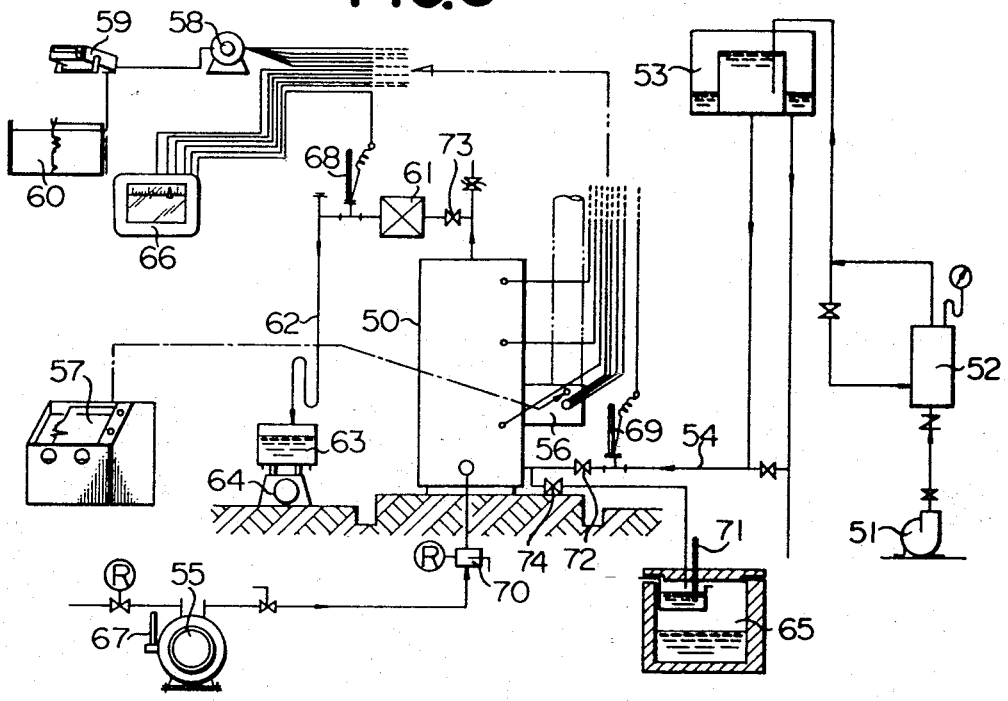
FIG. 8 is a schematic representation of a device for the purpose of testing the liquid heating apparatus according to the present invention.

To begin with, the testing device employed for testing the respective embodiments is as shown in FIG. 8, and particulars of this testing device as well as the method of measurement by means of this device will be explained with reference to the following Table-A through Table-H illustrative of the results of said measurement.

As the fluid to be subjected to heating with the liquid heating apparatus 50 according to the present invention, the underground water which will not be such influenced by the temperature of surrounding fluids is utilized. Referring to FIG. 8, the underground water is pumped up by the feed-water pump 51 and is adjusted to a prescribed pressure by means of the constant-pressure tank 52, introduced into the open tank 53, supplied to the liquid heating apparatus 50 via the water supply pipe 54 under a constant pressure, and its inlet temperature (105) is measured with the thermometer 69.

The city gas is introduced into a burner through a pipeline equipped with the pressure regulator 70 and the gas meter 55 to be burned therein. On this occasion, the gas pressure (109) is adjusted to a prescribed value by means of the pressure regulator 70, and the gas consumption (101) and gas temperature (102) are measured with said gas meter 55 and the thermometer 67. Moreover, an exhaust absorbing device (not shown) is equipped in the exhaust funnel 56, and analysis of the exhaust is conducted based on continuous recording by the infra-red $CO/CO_2$ analyzer 57 and the Orzert gas analyzer 57, whereby CO concentration (108) is calculated.

The measurement of the exhaust gas temperature (106) is conducted through the procedure comprising setting 12 units of C.A. thermocouples perpendicularly to the passage within the exhaust funnel 56 and reading the value indicated with the digital thermometer 59 by operating the thermocouple switch 58, thereby measuring the mean temperature at the cross section of said exhaust funnel while confirming unevenness of the value by means of the pen recorder 60.

In the case of constant pouring-out of hot water, by leaving the adjusting valve open, the water is supplied to the liquid heating apparatus 50 for heating, and the resulting hot water is supplied to the mixing chamber 61 through a supply pipe connected to a hot water faucet after adjusting its flow to a prescribed flow by means of the adjusting valve 73 provided at said supply pipe. After stirring within the mixing chamber 61 into a uniform temperature and measuring the outlet temperature (104) with the thermometer 68, the hot water is passed through the pipe 62 and stored in the hot-water reservoir 63. At this time, the weight of the hot water flowing per unit time is measured by means of a stop watch together with the weight gauge 64, and the flow quantity (103) is calculated based on the result of this measurement.

On the other hand, in the case of storing hot water, the valve 74 is first closed thereby filling up the liquid heating apparatus 50 with water. Then, the valve 72 is closed, the combustor is ignited, and upon attaining a temperature of 50° C as set with a thermostat not shown herein, said thermostat is actuated to extinguish fire. Immediately thereafter, the valve 74 of the hot water exit is opened thereby storing the hot water in the heat insulating tank 65, and the volume (111) of the thus stored hot water is measured with a weight gauge not shown herein while the temperature (110) thereof is measured with the thermometer 71. The surface temperature (107) of the heating apparatus 50 in motion is measured with the autographic recorder 66.

Experiment 1.

Figure 9A:
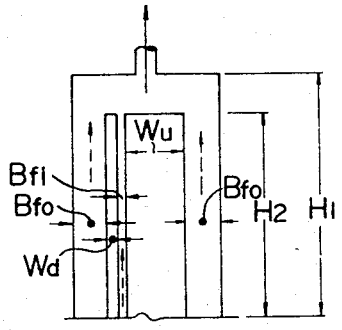
FIG. 9A is a front view of a part of the foregoing first embodiment for the purpose of illustrating the dimension of the respective part thereof.
Figure 9B:
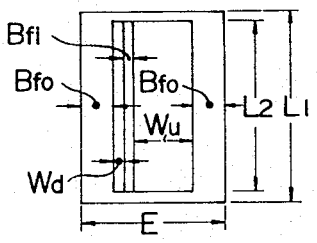
FIG. 9B is a plane figure of the same part as in FIG. 9A.

The liquid heating apparatus employed for the present experiment was of the same structure as that of the first embodiment and the radio $Sf$ of the width of liquid passages was fixed while the ratio $\xi f$ of the width of gas passages was set at various values. Referring to FIGS. 9A and 9B, the dimension of the respective parts was as shown in the following Table-1.

Table-1

| | No. | 1 | 2 | 3 | 4 | 5 | 6 | 7 |
|---|---|---|---|---|---|---|---|---|
| height | $H_1$ (mm) | 1120 | 1120 | 1120 | 1120 | 1120 | 1120 | 1120 |
| | $H_2$ (mm) | 1000 | 1000 | 1000 | 1000 | 1000 | 1000 | 1000 |
| longer latus | $L_1$ (mm) | 500 | 500 | 500 | 500 | 500 | 500 | 500 |
| | $L_2$ (mm) | 400 | 400 | 400 | 400 | 400 | 400 | 400 |
| shorter latus | E (mm) | 194.2 | 198.2 | 210.2 | 218.2 | 242.2 | 266.2 | 418.2 |
| width of rising heated gas chamber | Wu (mm) | 80 | 80 | 80 | 80 | 80 | 80 | 80 |
| width of falling heated gas space | Wd (mm) | 16 | 20 | 32 | 40 | 64 | 88 | 240 |
| ratio of width of gas passages | $\xi f = Wd/Wu$ | 0.20 | 0.25 | 0.40 | 0.50 | 0.80 | 1.10 | 3.00 |
| width of inside water jacket | Bfi (mm) | 7.4 | 7.4 | 7.4 | 7.4 | 7.4 | 7.4 | 7.4 |
| width of outside water jacket | Bfo (mm) | 45.4 | 45.4 | 45.4 | 45.4 | 45.4 | 45.4 | 45.4 |
| ratio of width of | Sf = Bfi/Bfo | 0.163 | 0.163 | 0.163 | 0.163 | 0.163 | 0.163 | 0.163 |
| heat transfer area | A ($m^2$) | 1.990 | 2.001 | 2.035 | 2.055 | 2.120 | 2.186 | 2.597 |

When a variety of liquid heating apparatuses according to the above design were tested by the use of the testing device illustrated in FIG. 8 with respect to their efficiency in the case of constant pouring-out of hot water, the result was as shown in the following Table-A, respectively.

Table-A

| | | No. | 1 | 2 | 3 | 4 | 5 | 6 | 7 |
|---|---|---|---|---|---|---|---|---|---|
| room temperature | | ° C | 17.5 | 20.5 | 25.5 | 28.0 | 27.0 | 24.0 | 21.5 |
| input | unit calorific value | Kcal/$Nm^3$ | 3062 | 3065 | 3091 | 3165 | 3102 | 3073 | 3065 |
| | fuel consumption (101) | $Nm^3/h$ | 6.82 | 6.81 | 7.27 | 8.45 | 9.34 | 10.41 | 12.40 |
| | fuel temperature (102) | ° C | 16.8 | 19.7 | 26.0 | 27.2 | 26.3 | 22.8 | 20.5 |
| | atmospheric pressure | mm Hg | 754.3 | 761.3 | 758.4 | 762.5 | 759.0 | 754.0 | 759.2 |
| | input (I.P) | Kcal/h | 20900 | 20897 | 22492 | 26776 | 29000 | 32000 | 38024 |
| output | flow quantity (103) | kg/h | 400 | 400 | 400 | 500 | 500 | 500 | 500 |
| | outlet temperature (104) | ° C | 64.5 | 65.0 | 67.2 | 63.0 | 62.3 | 61.7 | 60.9 |
| | inlet temperature | ° C | 13.8 | 13.7 | 13.8 | 14.0 | 14.0 | 13.5 | 13.5 |
| | difference between outlet & inlet temperatures | deg | 50.7 | 51.3 | 53.4 | 49.0 | 48.3 | 48.2 | 47.4 |
| | specific heat | Kcal/kg ° C | 1.0 | 1.0 | 1.0 | 1.0 | 1.0 | 1.0 | 1.0 |
| | specific weight | kg/$m^3$ | 1000 | 1000 | 1000 | 1000 | 1000 | 1000 | 1000 |
| | output (O.P) | Kcal/h | 20273 | 20500 | 21368 | 24500 | 24128 | 24096 | 23689 |
| thermal efficiency ($\eta$) | | % | 97.0 | 98.1 | 95.0 | 91.5 | 83.2 | 75.3 | 62.3 |
| exhaust gas temperature (106) | | ° C | 97.2 | 85.5 | 130.4 | 189.0 | 392.8 | 470.3 | 512 |
| surface temperature | | | | | | | | | |

Table-A-continued

| | | | | | | | | | |
|---|---|---|---|---|---|---|---|---|---|
| of heating apparatus 50 (107) | | ° C | 32.3 | 32.5 | 33.2 | 36.3 | 45.2 | 48.3 | 50.2 |
| exhaust gas heat loss | | % | 3.5 | 3.1 | 4.9 | 7.3 | 15.6 | 18.8 | 20.5 |
| combustion condition | CO concentration (108) | $CO/CO_2$ % | 0.0125 | 0.0003 | 0.0003 | 0.0003 | 0.0004 | 0.0004 | 0.0006 |
| | NOx | PPM | undetectable | undetectable | undetectable | undetectable | undetectable | undetectable | undetectable |
| burner | type of burner | BR-type | BR-100 | BR-100 | BR-100 | BR-100 | BR-100 | BR-100 | BR-100 |
| | diameter of nozzle | mm $\phi$ | 5.1$\phi$ ×2 | 5.1$\phi$ ×2 | 5.3$\phi$ ×2 | 5.6$\phi$ ×2 | 6.0$\phi$ ×2 | 6.0$\phi$ ×2 | 6.2$\phi$ ×2 |
| | regulated pressure (109) | mm Aq | 60 | 60 | 60 | 65 | 60 | 75 | 90 |
| remark | | compensation coefficient | 0.832 | 0.833 | 0.840 | 0.860 | 0.843 | 0.835 | 0.833 |

Further, when various liquid heating apparatus according to the design shown in Table-1 above were tested by the use of the testing device illustrated in FIG. 8 with respect to their efficiency in the case of storing hot water, the result was as shown in the following Table-B.

Table-B

| | | No. | 2 | 5 | 7 |
|---|---|---|---|---|---|
| room temperature | | ° C | 20.5 | 27.0 | 21.5 |
| input | unit calorific value | Kcal/Nm$^3$ | 3065 | 3102 | 3065 |
| | fuel consumption (101) | Nm$^3$/h | 1.08 | 1.69 | 3.4 |
| | fuel temperature (102) | ° C | 19.7 | 26.3 | 20.5 |
| | atmospheric pressure | mm Hg | 761.3 | 759.0 | 759.2 |
| | input (I.P) | Kcal/h | 3313 | 5254 | 10433 |
| output | mean temperature of hot water (110) | ° C | 62.3 | 64.8 | 65.5 |
| | inlet temperature (105) | ° C | 14.8 | 15.5 | 15.0 |
| | difference between outlet & inlet temperatures | deg | 47.5 | 49.3 | 50.5 |
| | specific heat | Kcal/kg ° C | 1.0 | 1.0 | 1.0 |
| | specific weight | kg/m$^3$ | 1000 | 1000 | 1000 |
| | volume of hot water in reservoir (111) | kg | 65 | 73 | 113 |
| | output (O.P) | Kcal/h | 3088 | 3599 | 5707 |
| thermal efficiency ($\eta$) | | % | 93.2 | 68.5 | 54.7 |
| exhaust gas temperature (106) | | ° C | 135.5 | 429 | 498 |
| surface temperature of heating apparatus 50 (107) | | ° C | 33.5 | 40.9 | 53.2 |
| exhaust gas heat loss | | % | 5.3 | 17.3 | 20.0 |
| combustion condition | CO concentration (108) | $CO/CO_2$ % | 0.0003 | 0.0006 | 0.0007 |
| | NOx | PPM | undetectable | undetectable | undetectable |
| burner | type of burner | BR-type | BR-100 | BR-100 | BR-100 |
| | diameter of nozzle | mm $\phi$ | 5.1$\phi$ ×2 | 6.0$\phi$ ×2 | 6.2$\phi$ ×2 |
| | regulated pressure (109) | mm Aq | 60 | 60 | 90 |

Figure 11:
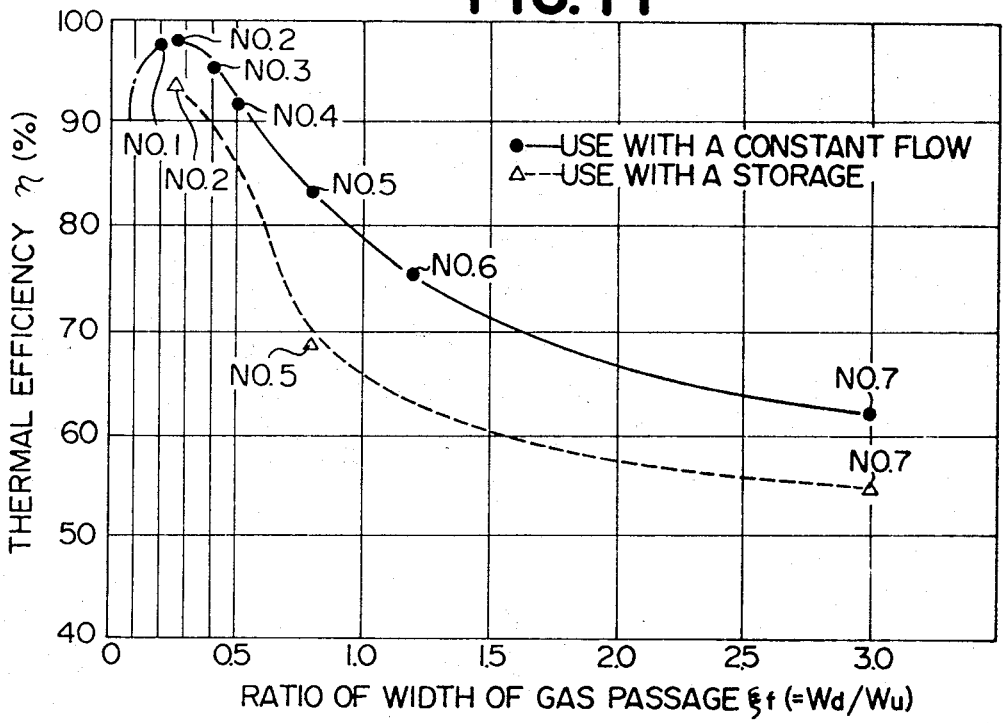
FIGS. 11 and 12 are respectively graphs illustrating the results of tests conducted by varying the width of the gas passage in the first and second embodiments.

Shown in FIG. 11 is a graph prepared on the basis of the above data. As a result of the foregoing test, it was verified that, when the ratio $\xi f$ of width of gas passages was set at 0.8 or less than 0.8, the thermal efficiency could be increased to more than 70%.

Experiment 2.

Figure 10A:
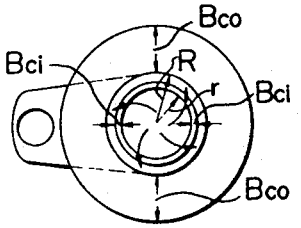
FIG. 10A is a front view of a part of the foregoing second embodiment for the purpose of illustrating the dimension of the respective part thereof.
Figure 10B:
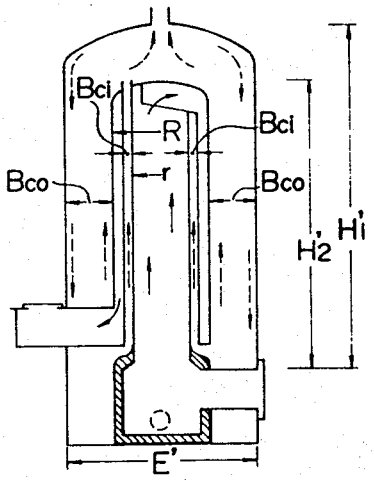
FIG. 10B is a plane figure of the same part as in FIG. 10A.

The liquid heating apparatus employed for the present experiment was of the same structure as that of the second embodiment and the ratio $So$ of width of liquid passages was fixed while the ratio $\xi c$ of width of gas passages was set at various values. Referring to FIGS. 10A and 10B, the dimension of the respective parts was as shown in the following Table-2.

Table-2

| | No. | 1 | 2 | 3 | 4 |
|---|---|---|---|---|---|
| height | $H_1$ (mm) | 1095 | 1095 | 1095 | 1095 |
| | $H_2$ (mm) | 1000 | 1000 | 1000 | 1000 |
| width | E (mm) | 385.2 | 399.8 | 512.6 | 831.6 |
| radius of heating gas space | R (mm) | 127.6 | 134.9 | 191.3 | 350.8 |
| radius of heating gas chamber | r (mm) | 106.3 | 106.3 | 106.3 | 106.3 |
| | $\xi c = R/r - 1$ | 0.200 | 0.269 | 0.800 | 2.300 |
| width of inside water jacket | Bci (mm) | 13 | 13 | 13 | 13 |
| width of outside water jacket | Bco (mm) | 65 | 65 | 65 | 65 |
| ratio of width of liquid passages | Sc = Bci/Bco | 0.20 | 0.20 | 0.20 | 0.20 |
| heat transfer area | A (m$^2$) | 1.849 | 1.986 | 2.345 | 3.445 |

When various liquid heating apparatuses according to the above design were tested by the use of the testing device illustrated in FIG. 8 with respect to their efficiency in the case of constant pouring-out of hot water, the result was as shown in the following Table-C respectively.

Table-C

| | | No. | 1 | 2 | 3 | 4 |
|---|---|---|---|---|---|---|
| room temperature | | ° C | 4.0 | 4.5 | 28.0 | 8.0 |
| input | unit calorific value | Kcal/Nm$^3$ | 3043 | 3032 | 3076 | 3054 |
| | fuel consumption (101) | Nm$^3$/h | 8.46 | 8.33 | 13.06 | 16.77 |
| | fuel temperature (102) | ° C | 6.2 | 6.8 | 27.1 | 26.8 |
| | atmospheric pressure | mm Hg | 748.2 | 736.6 | 739.5 | 751.7 |
| | input (I.P) | Kcal/h | 25751 | 25257 | 40200 | 51230 |
| output | flow quantity (103) | kg/h | 500 | 500 | 500 | 500 |
| | outlet temperature (104) | ° C | 60.4 | 61.0 | 60.0 | 57.5 |
| | inlet temperature (105) | ° C | 12.8 | 12.8 | 13.8 | 13.5 |
| | difference between outlet & inlet temperatures | deg | 47.6 | 48.2 | 46.2 | 44.0 |
| | specific heat | Kcal/kg ° C | 1.0 | 1.0 | 1.0 | 1.0 |
| | specific weight | kg/m$^3$ | 1000 | 1000 | 1000 | 1000 |
| | output (O.P) | Kcal/h | 23820 | 24120 | 32361 | 30789 |
| thermal efficiency ($\eta$) | | % | 92.5 | 95.5 | 80.5 | 60.1 |
| exhaust gas temperature (106) | | ° C | 154.8 | 118.0 | 397.7 | 552.0 |
| surface temperature of heating apparatus 50 (107) | | ° C | 29.2 | 28.7 | 39.6 | 45.5 |
| exhaust gas heat loss | | % | 5.9 | 4.4 | 15.8 | 22.2 |
| combustion condition | CO concentration (108) | CO/CO$_2$ % | 0.0015 | 0.0002 | 0.0003 | 0.0002 |
| | NOx | PPM | undetectable | undetectable | undetectable | undetectable |
| burner | type of burner | BR-type | BR-100 | BR-100 | BR-115 × 2 | BR-115 × 2 |
| | diameter of nozzle | mm $\phi$ | 5.6$\phi$ × 2 | 5.6$\phi$ × 2 | 5.0$\phi$ × 4 | 5.4$\phi$ × 4 |
| | regulated pressure (109) | mm Aq | 60 | 60 | 60 | 70 |
| remark | | compensation coefficient | 0.827 | 0.824 | 0.836 | 0.830 |

Moreover, when various liquid heating apparatuses according to the design shown in the foregoing Table-2 were tested by the use of the testing device illustrated in FIG. 8 with respect to their efficiency in the case of storing hot water, the result was as shown in the following Table-D respectively.

Table-D

| | | No. | 2 | 3 | 4 |
|---|---|---|---|---|---|
| room temperature | | ° C | 4.5 | 28.0 | 8.0 |
| input | unit calorific value | Kcal/Nm$^3$ | 3032 | 3076 | 3054 |
| | fuel consumption (101) | Nm$^3$/h | 1.53 | 2.45 | 3.31 |
| | fuel temperature (102) | ° C | 6.8 | 27.1 | 26.8 |
| | atmospheric pressure | mm Hg | 736.6 | 739.5 | 751.7 |
| | input (I.P) | Kcal/h | 4663 | 7545 | 10114 |
| output | mean temperature of hot water (110) | ° C | 63.0 | 63.6 | 63.9 |
| | inlet temperature (105) | ° C | 12.8 | 13.8 | 13.5 |
| | difference between outlet & inlet temperatures | deg | 50.2 | 49.8 | 50.4 |
| | specific heat | Kcal/kg ° C | 1.0 | 1.0 | 1.0 |
| | specific weight | kg/m$^3$ | 1000 | 1000 | 1000 |
| | volume of hot water in reservoir (111) | kg | 85 | 105 | 120 |
| | output (O.P) | Kcal/h | 4267 | 5229 | 6048 |
| thermal efficiency ($\eta$) | | % | 91.5 | 69.3 | 59.8 |
| exhausts gas temperature (106) | | ° C | 153.3 | 420.5 | 580.3 |
| surface temperature of heating apparatus 50 (107) | | ° C | 32.3 | 40.8 | 56.2 |
| exhaust gas heat loss | | % | 5.8 | 16.4 | 24.2 |
| combustion condition | CO concentration (108) | CO/CO$_2$ % | 0.0002 | 0.0003 | 0.0003 |
| | NOx | PPM | undetectable | undetectable | undetectable |
| burner | type of burner | BR-type | BR-100 | BR-115 × 2 | BR-115 × 2 |
| | diameter of nozzle | mm $\phi$ | 5.6$\phi$ × 2 | 5.0$\phi$ × 4 | 5.4$\phi$ × 4 |
| | regulated pressure (109) | mm Aq | 60 | 60 | 70 |

Figure 12:
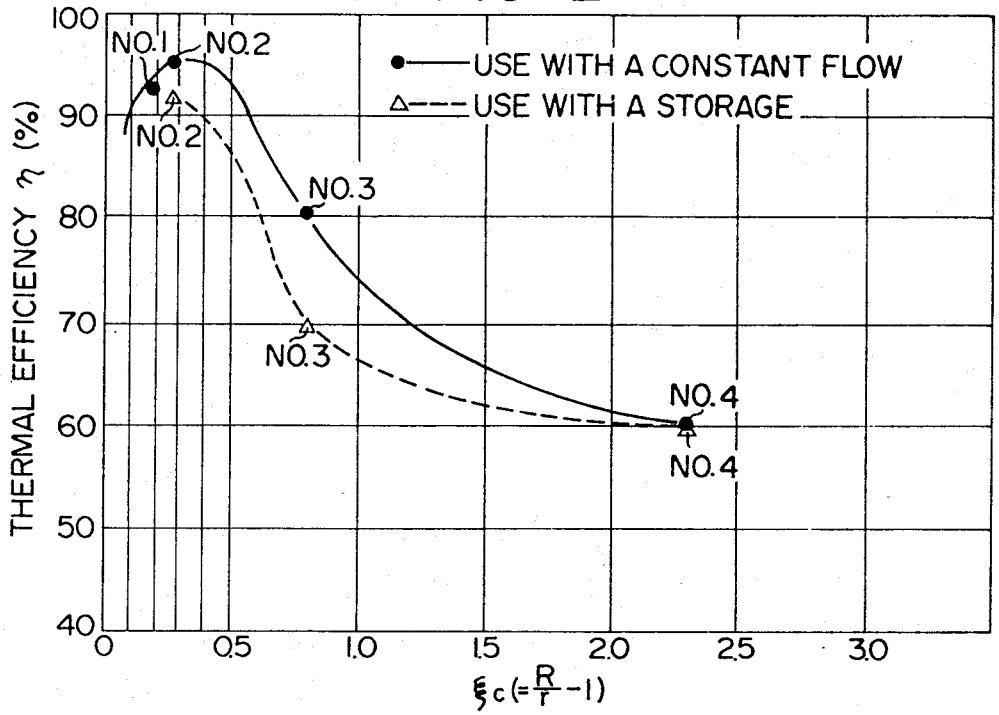

Shown in FIG. 12 is a graph prepared on the basis of the above data. As a result of the foregoing test, it was verified that, when the ratio $\xi c$ of width of gas passages was set at 0.8 or less than 0.8, the thermal efficiency could be increased to more than 70%.

Experiment 3

The liquid heating apparatus employed for the present experiment was of the same structure as that of the first embodiment and the ratio $\xi f$ of width of gas passages was fixed while the ratio $Sf$ of width of liquid passages was set at various values. Referring to FIGS. 9A and 9B, the dimension of the respective parts was as shown in the following Table-3.

Table-3

| | No. | 1 | 2 | 3 | 4 | 5 |
|---|---|---|---|---|---|---|
| height | $H_1$ (mm) | 1120 | 1120 | 1120 | 1120 | 1120 |

Table-3-continued

| | No. | 1 | 2 | 3 | 4 | 5 |
|---|---|---|---|---|---|---|
| | $H_2$ (mm) | 1000 | 1000 | 1000 | 1000 | 1000 |
| longer latus | $L_1$ (mm) | 500 | 500 | 500 | 500 | 500 |
| | $L_2$ (mm) | 400 | 400 | 400 | 400 | 400 |
| shorter latus | E (mm) | 198.20 | 205.80 | 213.50 | 236.20 | 251.20 |
| width of inside water jacket | Bfi (mm) | 7.4 | 15.0 | 22.7 | 45.4 | 60.4 |
| width of outside water jacket | Bfo (mm) | 45.4 | 45.4 | 45.4 | 45.4 | 45.4 |
| ratio of width of liquid passages | Sf = Bfi/Bfo | 0.163 | 0.330 | 0.500 | 1.000 | 1.33 |
| width of rising heated gas chamber | Wu (mm) | 80 | 80 | 80 | 80 | 80 |
| width of falling heated gas space | Wd (mm) | 20 | 20 | 20 | 20 | 20 |
| ratio of width of gas passages | ξf = Wd/Wu | 0.25 | 0.25 | 0.25 | 0.25 | 0.25 |
| heat transfer area | A ($m^2$) | 2.001 | 2.019 | 2.046 | 2.105 | 2.153 |

When a variety of liquid heating apparatuses according to the above design were tested by the use of the testing device illustrated in FIG. 8 with respect to their efficiency in the case of constant pouring-out of hot water, the result was as shown in the following Table-E respectively.

Next, when a variety of liquid heating apparatuses according to the above design were tested by the use of a testing device illustrated in FIG. 8 with respect to their efficiency in the case of storing hot water, the result was as shown in the following Table-F respectively.

Table-E

| | | No. | 1 | 2 | 3 | 4 | 5 |
|---|---|---|---|---|---|---|---|
| room temperature | | ° C | 20.5 | 3.8 | 3.5 | 6.8 | 8.9 |
| input | unit calorific value | Kcal/$Nm^3$ | 3065 | 3021 | 3025 | 3040 | 3051 |
| | fuel consumption (101) | $Nm^3$/h | 6.81 | 6.86 | 6.85 | 6.83 | 6.82 |
| | fuel temperature (102) | ° C | 19.7 | 5.7 | 5.9 | 7.2 | 7.9 |
| | atmospheric pressure | mm Hg | 761.3 | 754.7 | 760.1 | 767.7 | 759.8 |
| | input (I.P) | Kcal/h | 20897 | 20724 | 20721 | 20763 | 20808 |
| output | flow quantity (103) | kg/h | 400 | 400 | 400 | 400 | 400 |
| | outlet temperature (104) | ° C | 65.0 | 62.0 | 58.6 | 51.7 | 47.7 |
| | inlet temperature (105) | ° C | 13.7 | 13.1 | 13.1 | 13.3 | 13.3 |
| | difference between outlet & inlet temperatures | deg | 51.3 | 48.9 | 45.5 | 38.4 | 34.2 |
| | specific heat | Kcal/kg ° C | 1.0 | 1.0 | 1.0 | 1.0 | 1.0 |
| | specific weight | kg/$m^3$ | 1000 | 1000 | 1000 | 1000 | 1000 |
| | output (O.P) | Kcal/h | 20500 | 19584 | 18193 | 15365 | 13692 |
| thermal efficiency (η) | | % | 98.1 | 94.5 | 87.8 | 74.0 | 65.8 |
| exhaust gas temperature (106) | | ° C | 85.5 | 119.0 | 201.2 | 292.8 | 333.0 |
| surface temperature of heating apparatus 50 (107) | | ° C | 32.5 | 33.0 | 33.5 | 36.0 | 36.0 |
| exhaust gas heat loss | | % | 3.1 | 4.4 | 7.8 | 11.5 | 13.2 |
| combustion condition | CO concentration (108) | $CO/CO_2$ % | 0.0003 | 0.0003 | 0.0003 | 0.0003 | 0.0003 |
| | NOx | PPM | undetectable | undetectable | undetectable | undetectable | undetectable |
| burner | type of burner | BR-type | BR-100 | BR-100 | BR-100 | BR-100 | BR-100 |
| | diameter of nozzle | mm ϕ | 5.1ϕ × 2 | 5.1ϕ × 2 | 5.1ϕ × 2 | 5.1ϕ × 2 | 5.1ϕ × 2 |
| | regulated pressure (109) | mm Aq | 60 | 60 | 60 | 60 | 60 |
| remark | | compensation coefficient | 0.833 | 0.821 | 0.822 | 0.826 | 0.829 |

Herein:
input (I.P) = unit calorific value × fuel consumption
output(O.P) = flow quantity × specific heat × difference between inlet and outlet temperatures
thermal efficiency (η) = output/input
exhaust gas heat loss (ρ) = V(cgtg − coto) × Hu
wherein V: amount of exhaust at a temperature tg
Hu: amount of exhaust at a low calorific value
cg, co: specific heat of heated gas at tg, to
tg, to: exhaust gas temperature, atmospheric temperature Table-F

| | | No. | 1 | 3 | 4 | 5 |
|---|---|---|---|---|---|---|
| room temperature | | ° C | 20.5 | 3.5 | 6.8 | 8.9 |
| input | unit calorific value | Kcal/$Nm^3$ | 3065 | 3025 | 3040 | 3051 |
| | fuel consumption (101) | $Nm^3$/h | 1.11 | 1.41 | 2.05 | 2.46 |
| | fuel temperature (102) | ° C | 19.7 | 5.9 | 7.2 | 7.9 |
| | atmospheric pressure | mm Hg | 761.3 | 760.1 | 767.7 | 759.8 |
| | input (I.P) | Kcal/h | 3413 | 4266 | 6262 | 7506 |
| output | mean temperature of hot water (110) | ° C | 63.0 | 63.3 | 62.2 | 62.5 |
| | inlet temperature (105) | ° C | 13.7 | 13.1 | 13.3 | 13.3 |
| | difference between outlet & inlet temperatures | deg | 49.3 | 50.2 | 48.9 | 49.2 |
| | specific heat | Kcal/kg ° C | 1.0 | 1.0 | 1.0 | 1.0 |
| | specific weight | kg/$m^3$ | 1000 | 1000 | 1000 | 1000 |
| | volume of hot water in reservoir (111) | kg | 65 | 69 | 84 | 92 |

Table-F-continued

| | | No. | 1 | 3 | 4 | 5 |
|---|---|---|---|---|---|---|
| output (O.P) | | Kcal/h | 3205 | 3464 | 4108 | 4526 |
| thermal efficiency (η) | | % | 93.9 | 81.2 | 65.6 | 60.3 |
| exhaust gas temperature (106) | | °C | 112.5 | 273.3 | 408.3 | 423.9 |
| surface temperature of heating apparatus 50 (107) | | °C | 34.5 | 35.1 | 42.3 | 48.6 |
| exhaust gas heat loss | | % | 4.3 | 12.0 | 16.0 | 17.2 |
| combustion condition | CO concentration (108) | $CO/CO_2$ % | 0.0003 | 0.0003 | 0.0025 | 0.0040 |
| | NOx | PPM | undetectable | undetectable | undetectable | undetectable |
| burner | type of burner | BR-type | BR-100 | Br-100 | BR-100 | BR-100 |
| | diameter of nozzle | mm ϕ | 5.1ϕ × 2 | 5.1ϕ × 2 | 5.1ϕ × 2 | 5.1ϕ×2 |
| | regulated pressure (109) | mm Aq | 60 | 60 | 60 | 60 |

Figure 13:
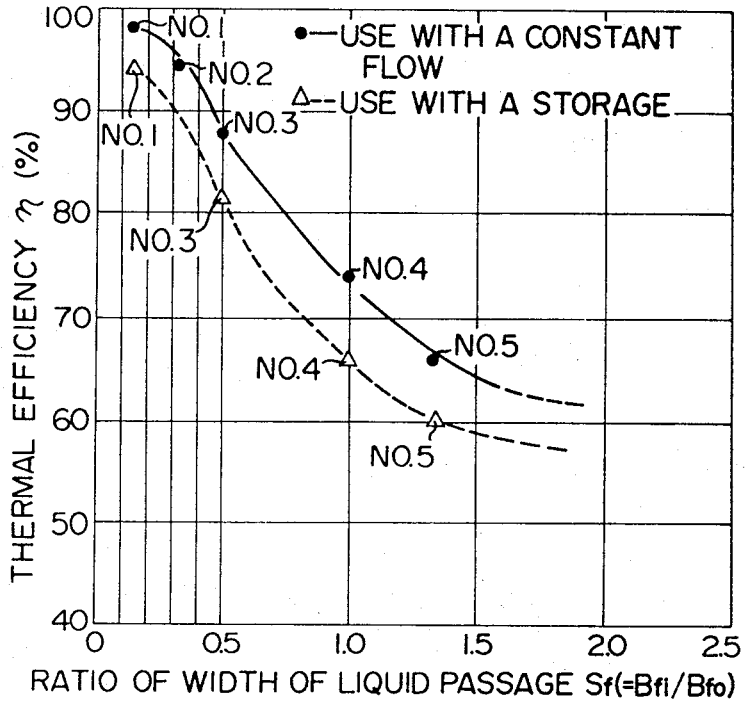
Figure 7:
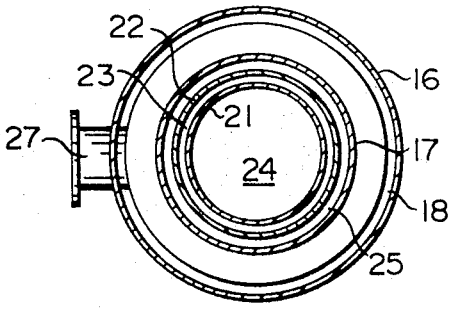
Figure 9A:
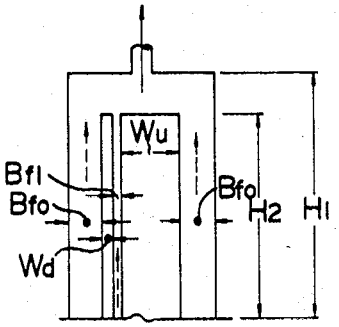
Figure 10A:
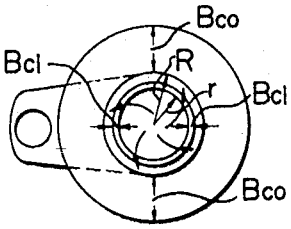
Figure 10B:
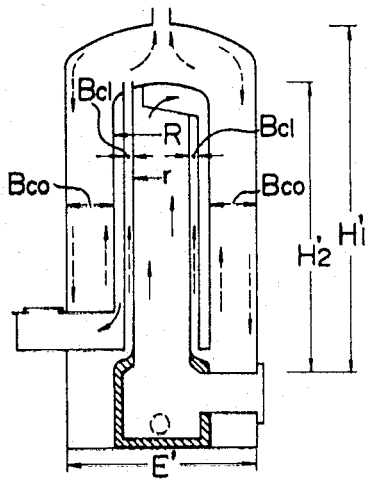
Figure 9B:
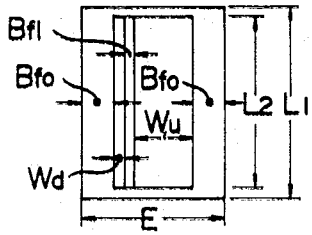

Shown in FIG. 13 is a graph prepared on the basis of the above data. As a result of the foregoing test, it was verified that, when the ratio S*f* of width of liquid passages was set at 0.8 or less than 0.8, the thermal efficiency could be increased to more than 70%.

Experiment 4

The liquid heating apparatus employed for the present experiment was of the same structure as that of the second embodiment and the ratio ξc of width of gas passages was fixed while the ratio Sc of width of liquid passages was set at various values. Referring to FIGS. 11A and 11B, the dimension of the respective parts was as shown in the following Table-4.

Table-4

| | No. | 1 | 2 | 3 | 4 | 5 |
|---|---|---|---|---|---|---|
| height | $H_1$ (mm) | 1095 | 1095 | 1095 | 1095 | 1095 |
| | $H_2$ (mm) | 1000 | 1000 | 1000 | 1000 | 1000 |
| width | $E^f$ (mm) | 399.8 | 399.8 | 399.8 | 399.8 | 399.8 |
| width of inside water jacket | Bci (mm) | 13 | 26 | 39 | 65 | 130 |
| width of outside water jacket | Bco (mm) | 65 | 65 | 65 | 65 | 65 |
| ratio of width of liquid passages | Sc = Bci/Bco | 0.20 | 0.40 | 0.60 | 1.00 | 2.00 |
| radius of heating gas space | R (mm) | 134.9 | 134.9 | 134.9 | 134.9 | 134.9 |
| radius of heating gas chamber | r (mm) | 106.3 | 106.3 | 106.3 | 106.3 | 106.3 |
| | ξc = R/r − 1 | 0.269 | 0.269 | 0.269 | 0.269 | 0.269 |
| heat transfer area | A ($m^2$) | 1.986 | 2.106 | 2.183 | 2.550 | 3.318 |

When a variety of liquid heating apparatuses according to the above design were tested by the use of the testing device illustrated in FIG. 8 with respect to their efficiency in the case of constant pouring-out of hot water, the result was as shown in the following Table-G respectively.

Table-G

| | | No. | 1 | 2 | 3 | 4 | 5 |
|---|---|---|---|---|---|---|---|
| room temperature | | °C | 4.5 | 12.0 | 15.0 | 18.5 | 8.8 |
| input | unit calorific value | Kcal/$Nm^3$ | 3032 | 3054 | 3058 | 3062 | 3054 |
| | fuel consumption (101) | $Nm^3$/h | 8.33 | 8.25 | 8.24 | 8.23 | 8.25 |
| | fuel temperature (102) | °C | 6.8 | 12.5 | 13.8 | 17.1 | 7.9 |
| | atmospheric pressure | mm Hg | 736.6 | 762.2 | 761.0 | 738.4 | 759.8 |
| | input (I.P) | Kcal/h | 25257 | 25210 | 25209 | 25188 | 25199 |
| output | flow quantity (103) | kg/h | 500 | 500 | 500 | 500 | 500 |
| | outlet temperature (104) | °C | 61.0 | 59.1 | 57.6 | 51.9 | 47.9 |
| | inlet temperature (105) | °C | 12.8 | 13.5 | 13.5 | 13.8 | 13.0 |
| | difference between outlet & inlet temperatures | deg | 48.2 | 45.6 | 44.1 | 38.1 | 34.9 |
| | specific heat | Kcal/kg °C | 1.0 | 1.0 | 1.0 | 1.0 | 1.0 |
| | specific weight | kg/$m^3$ | 1000 | 1000 | 1000 | 1000 | 1000 |
| | output (O.P) | Kcal/h | 24120 | 22815 | 22058 | 19067 | 17438 |
| thermal efficiency (η) | | % | 95.5 | 90.5 | 87.5 | 75.7 | 69.2 |
| exhaust gas temperature (106) | | °C | 118.0 | 178.5 | 209.3 | 298.5 | 301.5 |
| surface temperature of heating apparatus 50 (107) | | °C | 28.7 | 35.2 | 36.0 | 36.0 | 34.8 |
| exhaust gas heat loss | | % | 4.4 | 6.9 | 8.1 | 11.8 | 11.9 |
| combustion condition | CO concentration (108) | $CO/CO_2$ % | 0.0002 | 0.0003 | 0.0003 | 0.0003 | 0.0002 |
| | NOx | PPM | undetectable | undetectable | undetectable | undetectable | undetectable |
| burner | type of burner | BR-type | BR-100 | BR-100 | BR-100 | BR-100 | BR-100 |
| | diameter of nozzle | mm ϕ | 5.6ϕ×2 | 5.6ϕ×2 | 5.6ϕ×2 | 5.6ϕ×2 | 5.6ϕ×2 |
| | regulated pressure (109) | mm Aq | 60 | 60 | 60 | 60 | 60 |
| remark | | compensation coefficient | 0.824 | 0.83 | 0.831 | 0.832 | 0.830 |

Moreover, when a variety of liquid heating apparatuses according to the above design were tested by the use of the testing device illustrated in FIG. 8 with respect to their efficiency in the case of storing hot water, the result was as shown in the following Table-H respectively.

Table-H

| | No. | 1 | 3 | 4 | 5 |
|---|---|---|---|---|---|
| room temperature | °C | 4.5 | 15.0 | 18.5 | 8.8 |

Table-H-continued

| | | No. | 1 | 3 | 4 | 5 |
|---|---|---|---|---|---|---|
| input | unit calorific value | Kcal/Nm$^3$ | 3032 | 3058 | 3062 | 3054 |
| | fuel consumption (101) | Nm$^3$/h | 1.56 | 1.84 | 2.92 | 4.95 |
| | fuel temperature (102) | ° C | 6.8 | 13.8 | 17.1 | 7.9 |
| | atmospheric pressure | mm Hg | 736.6 | 761.0 | 738.4 | 759.8 |
| | input (I.P) | Kcal/h | 4751 | 5636 | 8964 | 15129 |
| output | mean temperature of hot water (110) | ° C | 64.0 | 63.3 | 63.4 | 61.9 |
| | inlet temperature (105) | ° C | 12.8 | 13.5 | 13.8 | 13.0 |
| | difference between outlet & inlet temperatures | deg | 51.2 | 49.8 | 49.6 | 48.9 |
| | specific heat | Kcal/kg ° C | 1.0 | 1.0 | 1.0 | 1.0 |
| | specific weight | kg/m$^3$ | 1000 | 1000 | 1000 | 1000 |
| | volume of hot water in reservoir (111) | kg | 85 | 92 | 120 | 185 |
| | output (O.P) | Kcal/h | 4352 | 4582 | 5952 | 9047 |
| thermal efficiency ($\eta$) | | % | 91.6 | 81.3 | 66.4 | 59.8 |
| exhaust gas temperature (106) | | ° C | 165.2 | 253.5 | 413.0 | 579.3 |
| surface temperature of heating apparatus 50 (107) | | ° C | 31.3 | 38.9 | 43.0 | 55.2 |
| exhaust gas heat loss | | % | 6.2 | 10.5 | 16.5 | 24.5 |
| combustion condition | CO concentration (108) | CO/CO$_2$ % | 0.0002 | 0.0003 | 0.0015 | 0.0023 |
| | NOx | PPM | undetectable | undetectable | undetectable | undetectable |
| burner | type of burner | BR-type | BR-100 | BR-100 | BR-100 | BR-100 |
| | diameter of nozzle | mm $\phi$ | 5.6$\phi$ × 2 | 5.6$\phi$ × 2 | 5.6$\phi$ × 2 | 5.6$\phi$ × 2 |
| | regulated pressure (109) | mm Aq | 60 | 60 | 60 | 60 |

Shown in FIG. 14 is a graph prepared on the basis of the above data. As a result of the foregoing test, it was verified that, when the ratio S*c* of width of liquid passages was set at 0.8 or less than 0.8, the thermal efficiency could be increased to more than 70%.

What is claimed is:

1. A liquid heating apparatus comprising a vertical rectangular outer body portion, an inner body portion which has a shape substantially the same as that of said outer body portion, said inner body portion being disposed within said outer body portion and being spaced therefrom to define an outside water jacket therebetween, two vertically oriented plate members disposed within said inner body portion, said plate members being spaced from each other to define an inside water jacket therebetween, said plate members also being spaced from said inner body to define therewith a first chamber which extends alongside one of said plate members and through which heated gas rises and a second chamber which extends alongside the other of said plate members and through which said gas descends, said first chamber communicating with said second chamber at their upper ends, the ratio $\xi f$ of the width W*d* of said second chamber to the width W*u* of said first chamber being equal to or less than 0.8, a flue at the upper end of said first chamber and communicating with said second chamber, a flue gas exit provided at the lower end of said second chamber, an exhaust pipe communicating at one end thereof with said flue gas exit, means defining a combustion chamber at the lower end of said first chamber, and a combustion air supply tube surrounding the outside of said exhaust pipe and being spaced therefrom, one end of said air supply tube communicating with an opening in the side wall of said outer body portion and thereby communicating with said combustion chamber.

2. A liquid heating apparatus according to claim 1, wherein the ratio S*f* of the width of the liquid passage B*fi* in said inside water jacket to the width of the liquid passage B*fo* in said outside water jacket is equal to 0.8 or less than 0.8.

3. An apparatus for heating a liquid comprising wall means defining an elongated vertical interior liquid flow passage for heating liquids and an elongated vertical exterior liquid flow passage for heating liquids, said exterior passage encircling said interior passage and extending substantially parallel therewith, the transverse thickness of said interior passage being not more than 0.8 times the transverse thickness of said external passage and means connecting the upper ends and the lower ends of said interior and exterior passages to define a closed conduit for the flow of the liquid through said interior and exterior passages; means defining a first elongated vertical gas flow path in indirect heat exchange relationship with said interior liquid flow passage and extending parallel therewith, means defining a second elongated vertical gas flow path in indirect heat relationship with both said interior and exterior liquid flow passages and extending parallel therewith, the transverse thickness of said second path being not more than 0.8 times the transverse thickness of said first path; means defining a combustion chamber at the lower end of said first vertical gas flow path and burner means in said combustion chamber for supplying heated gas to the lower end of said first path; an exhaust pipe for discharging heated gas from the lower end of said second vertical gas flow path and means connecting the upper ends of said first and second vertical gas flow paths; a combustion air supply tube surrounding the outside of said exhaust pipe and being spaced therefrom, one end of said air supply tube communicating with said combustion chamber for supplying combustion air thereto; the flow of hot gas through said first gas flow path being effective to heat the liquid in said interior passage more rapidly than the liquid in said exterior passage is heated whereby to cause upward movement of the liquid through the interior passage and downward movement of the liquid through the exterior passage and to rapidly cool the gas flowing upwardly in said first vertical gas flow path so that the gas in the second vertical gas flow path is relatively cooled to improve the draft of gas through said first and second paths.

4. An apparatus as claimed in claim 3 in which said exterior liquid flow passage, said interior liquid flow passage and said first and second gas flow paths are defined by an elongated vertical outer hollow body of rectangular cross-section, an elongated vertical inner hollow body of rectangular cross-section disposed within and spaced on all sides from said outer hollow body to define therebetween said exterior liquid flow passage, and a pair of parallel spaced-apart vertical plates disposed within said inner hollow body, said plates extending parallel to two side walls of said inner hollow body and extending between the two end walls of said inner hollow body, said plates defining therebetween said interior liquid flow passage, the space between one of said plates and one of said side walls of said inner hollow body defining said first gas flow path and the space between the other of said plates and the other of said side walls of said inner hollow body defining said second gas flow path.

* * * * *